United States Patent [19]

Schippers

[11] 4,376,517

[45] Mar. 15, 1983

[54] METHOD AND APPARATUS FOR DEPOSITING YARN

[75] Inventor: Heinz Schippers, Remscheid, Fed. Rep. of Germany

[73] Assignee: Barmag Barmer Maschinenfabrik AG, Remscheid-Lennep, Fed. Rep. of Germany

[21] Appl. No.: 253,804

[22] Filed: Apr. 13, 1981

[30] Foreign Application Priority Data

Apr. 16, 1980 [DE] Fed. Rep. of Germany ..... 3014516

[51] Int. Cl.[3] ..... B65H 54/82

[52] U.S. Cl. ..... 242/47; 28/289; 242/47.13

[58] Field of Search ..... 242/47, 47.01, 47.12, 242/47.13, 47.08, 47.09, 47.1, 47.11, 82, 83; 28/289; 19/159 A

[56] References Cited

U.S. PATENT DOCUMENTS

| | | | |
|---|---|---|---|
| 2,010,878 | 8/1935 | Murphy et al. | 242/47 |
| 2,936,877 | 5/1960 | Adams et al. | 242/47.09 |
| 3,469,796 | 9/1969 | Russell et al. | 242/47.13 |
| 3,478,399 | 11/1969 | Wyatt et al. | 242/47 X |
| 3,675,864 | 7/1972 | Eschenbach | 242/47 |
| 3,776,480 | 12/1973 | Lawson | 242/47.13 X |
| 3,909,892 | 10/1975 | Crotti | 28/289 |
| 4,221,345 | 9/1980 | Schippers et al. | 242/47 |
| 4,304,366 | 12/1981 | Enneking et al. | 242/47.13 X |
| 4,313,550 | 2/1982 | Van Gorp | 242/47 |

FOREIGN PATENT DOCUMENTS

| | | | |
|---|---|---|---|
| 2427722 | 12/1975 | Fed. Rep. of Germany . | |
| 2741273 | 3/1978 | Fed. Rep. of Germany | 242/47.13 |
| 2705521 | 8/1978 | Fed. Rep. of Germany | 242/47 |
| 2844477 | 4/1980 | Fed. Rep. of Germany . | |

*Primary Examiner*—Stanley N. Gilreath
*Attorney, Agent, or Firm*—John H. Shurtleff

[57] ABSTRACT

A method and apparatus for depositing yarn in the form of free-falling helical windings reshaped into an elongated, closed curve configuration and laid into a spinning can with a traversing movement so that one end of the closed curve remains on the inner wall of the can while the other end is moved back and forth in an annular zone between the inner wall of the can and its center. The resulting yarn deposit is very uniform over the can cross section and the collected yarn has improved run-off properties.

10 Claims, 4 Drawing Figures

METHOD AND APPARATUS FOR DEPOSITING YARN

BACKGROUND OF THE INVENTION

In known methods and apparatus for depositing a continuously forwarded synthetic fiber yarn into a spinning can, the yarn is conducted through a tube or channel with an outlet guide which orbits in a substantially horizontal circular path at about the linear velocity of the yarn. The yarn exits from the outlet guide in the form of freely flying helical windings and then falls freely, either directly or after falling off from an intermediate winding body, into a round spinning can which moves back and forth or rotates, whereby the yarn when leaving the outlet guide has lost most if not all of its translatory velocity in the direction of the linear yarn axis.

These known methods and apparatus serve the purpose of reducing the linear speed of a rapidly forwarded yarn composed of continuous synthetic fibers or filaments, e.g. from an arrival or feed speed of of more than 1000 meters per minute down to zero linear velocity or at least down to a very low velocity such that the yarn can be deposited without damage and without tangling as it is laid down in the spinning can. Attention is directed to the following applications or patents for these known methods and apparatus, the disclosure of each of these references being incorporated herein by reference as fully as if set forth in their entirety:

- DE-OS No. 25 40 148, corresponding to U.S. Pat. No. 4,221,345;
- DE-OS No. 28 44 477, as discussed more fully below; and
- DE-OS No. 28 09 661, corresponding to U.S. application Ser. No. 18,406, filed Mar. 7, 1979, now abandoned.

One of the problems in carrying out the known methods has been the uneven or irregular deposit of the windings in the spinning can so that more yarn collects in some areas than it does in other areas of the depositing surface. One attempt to solve this kind of problem is given in German published specification DE-OS No. 24 27 722 wherein the method of depositing the yarn includes a spinning can or pot which rotates while the depositing means directs the yarn windings in a traversing movement back and forth between two points which lie in the region of the spinning can circumference, i.e. between two diametrically opposed points. Here again the results have not been uniform or fully satisfactory.

Prior methods and apparatus have thus taken into some degree of consideration the need to uniformly deposit the yarn windings, i.e. so that the spinning can is filled uniformly over its cross section. However, the desired improvement was not achieved with the disclosed rotation of the spinning cans, because the depositing area of the can per revolution increases parabolically from inside to outside and thereby the filling, with a constant feed of yarn, decreases parabolically with the depositing radius. Furthermore, in each back and forth traversing movement at the end points of this movement, i.e. at the outer circumferential edges of the spinning can, less yarn is deposited than in the middle or central depositing areas. Accordingly, while the prior methods offer some approximation of a uniform filling in a traversing movement of the windings as they are laid into a rotating can, it has not been possible to obtain a truly uniform layering or planar deposition of the yarn windings, free of distortion or uneven areas of deposition.

SUMMARY OF THE INVENTION

It is an object of the present invention to provide a method and suitable apparatus which will ensure a uniform filling of the spinning can over its cross section, i.e. so that the plane of deposit in the spinning can as it is filled remains substantially level and much more uniformly occupied by the yarn windings as they are laid down one over another.

This object is achieved, in accordance with the invention, by a specific set of steps in the otherwise generally known method for depositing a continuously forwarded yarn into a round, rotating spinning can wherein the yarn is conducted in its axial direction through a guide channel having an outlet guide which orbits in a substantially horizontal circular path at about the linear velocity of the yarn and wherein the yarn is subsequently permitted to fall freely in helically shaped windings onto the circular collecting plane of the spinning can.

The "collecting plane" is the horizontal circular bottom of the spinning can or planes parallel thereto as the can is filled. The surface in the can onto which the windings are deposited may or may not be approximately planar, depending upon the uniformity with which the yarn is laid in each horizontal cross section.

One of the essential steps of the improved method of the invention is to shape the yarn windings before their impingement onto the collecting plane by means of axially extending shaping surfaces placed in contact with the yarn windings so that each yarn winding defines, in its projection onto the collecting plane of the spinning can, an elongated, closed curve with rounded ends. These yarn windings are thus deformed or reshaped in such a way that they do not circumscribe a circular area but rather an elongated, closed, smooth curve in the form of a circle which has been squeezed together from diametrically opposite points while retaining rounded ends.

The reshaped windings may be in the form of an ellipse, any oval shape or even an oval constricted or necked down in its midsection, i.e. a closed curve which has convex rounded ends and a concave midsection with reference to its center point. The closed curve may also be initially formed as an elongated polygonal shape, e.g. a hexagon, with its sides joined into a smooth curve. Shapes which are similar to these basic shapes may also be used and it is not essential for the reshaped or reformed spiral winding to be absolutely symmetrical about a centerline.

The other essential step of the invention requires a movement of the windings, as a whole, horizontally with reference to the collecting plane such that the closed curve defined or circumscribed by each winding is always disposed with one end on the outer circumference of the depositing plane and with the other end being moved back and forth in an annular zone between the outer circumference of the depositing plane of the spinning can and its center. It is possible to carry out this traversing movement with suitable shaping means which at the same time provide the needed shape or configuration of the windings in such a manner that the extent to which the spinning can is filled is always substantially constant over horizontal cross sections or individual layers of windings, thereby avoiding disturbances in the subsequent run-off of the yarn.

In this respect, it must also be noted that the special forming or reshaping of the yarn windings according to the first aspect of the invention leads in itself to a substantial improvement in the run-off properties of the yarn.

THE DRAWINGS

The invention is further described below with the aid of the accompanying drawings in which.

Figure 1:
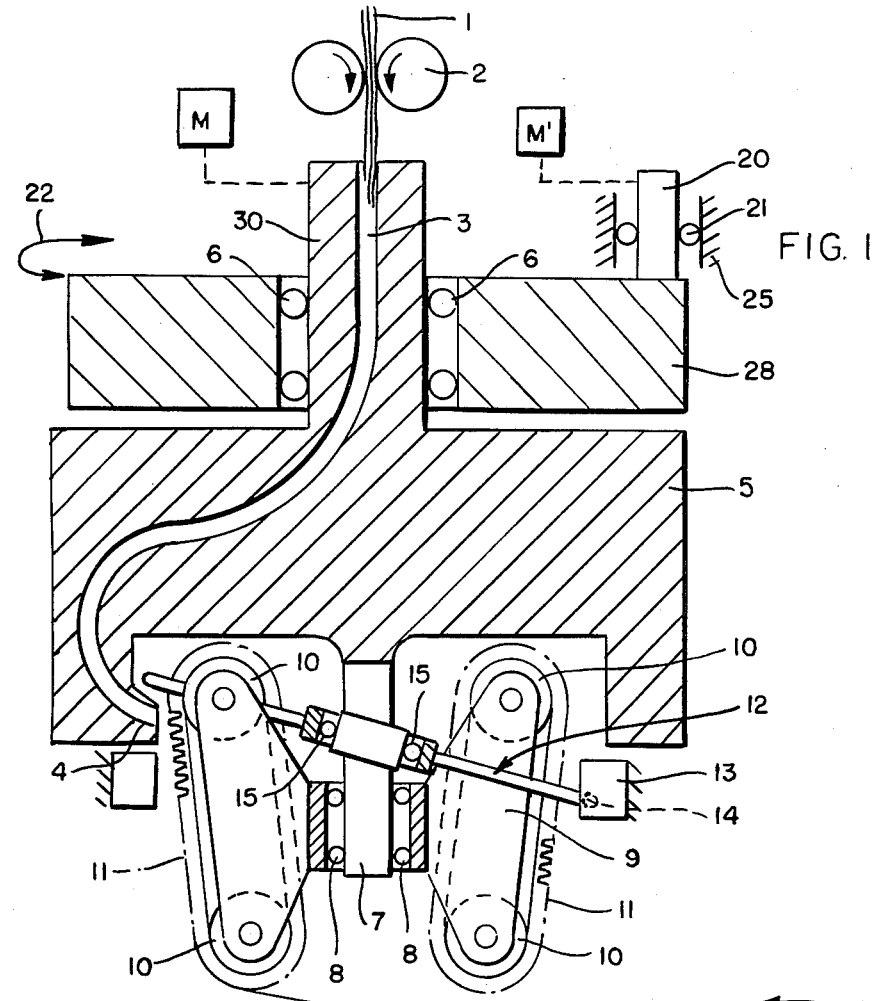
FIG. 1 is a longitudinal section through the axis of one embodiment of apparatus according to the invention which deposits and shapes yarn windings for collection in a spinning can.

In view of the generally known features of much of the illustrated apparatus, the drawings are partly schematic and may be only briefly described to avoid unnecessary details and explanations of subject matter readily available in the drawings and specifications of earlier patents and patent applications. And it will be further understood that the two examples of essentially different types of apparatus for depositing yarn windings are intended as being illustrative only and not the only alternative means of carrying out the invention. The method of the invention is readily adaptable to these and other apparatus without departing from the spirit and scope of the invention.

DETAILED DESCRIPTION OF THE INVENTION

Figure 2:
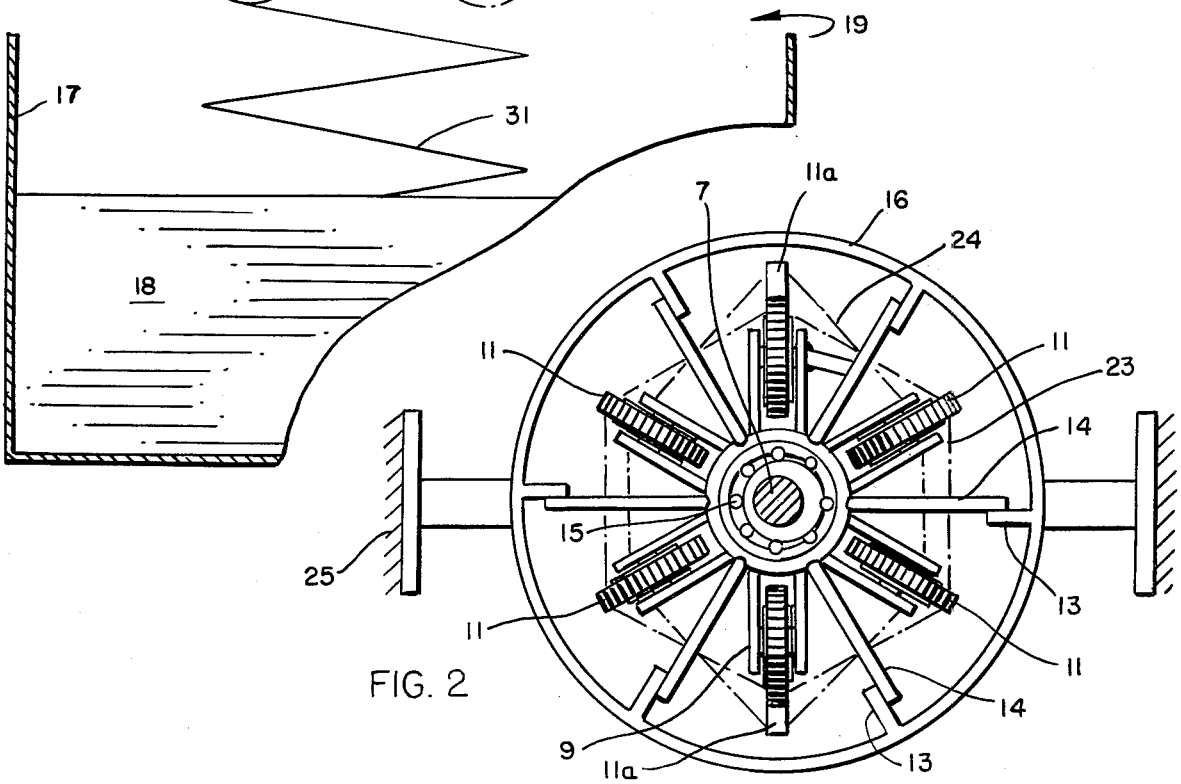
FIG. 2 is a horizontal section through the lower portion of the depositing apparatus of FIG. 1, as viewed from above and with some portions omitted.

In the yarn depositing apparatus shown in FIGS. 1 and 2, the yarn 1 is conducted by the feed rolls 2 into the yarn channel or tube 3 where it is forwarded up to its emergence at the yarn outlet guide 4. This yarn channel 3 and its outlet guide 4 are located or seated in the rotor 5 which in turn is mounted on the bearings 6 and driven by a motor M in such a way that the mouth of the outlet guide 4 orbits at about the same speed as the linear velocity of the yarn. In this manner, the yarn as delivered from the feed rolls 2 and channel 3 are initially laid out as circular or helical windings which are wound onto the winding cage 9 float mounted on the trunnion or lower pin shaft 7 of the rotor 5. This winding cage 9 is rotatably mounted on the bearings 8 of the pivot or pin shaft 7. This winding cage 9 is in the form of a rotatable and tapered drum-shaped member and contains a plurality of endless conveyor belts 11 which circulate on the freely turnable and paired sets of rollers 10. There are several conveyor belts 11 distributed about the circumference of the winding cage 9 so that the yarn is initially wound as a polygon on this cage, e.g. in the shape of a hexagon as indicated in FIG. 2.

In order to axially convey or forward the yarn windings in a downward direction and to prevent the cage 9 from turning, use is made of the rotary star member 12 which is borne on the trunnion or pin shaft 7 so as to wobble or tumble on the bearing 15. This rotary star 12 has a number of radial fingers or spokes 14, and the stop members 13 are arranged on the machine frame in the region of the ends of said fingers 14 to hold the rotary star fast against rotational movement about the rotor axis.

Apparatus of the type shown in FIGS. 1 and 2 is described in greater detail in the above-noted German patent specification DE-OS No. 28 44 477. The same basic structure and arrangement are used in the present invention with a suitable modification of the cage member 9 to achieve the desired reshaping of the yarn windings as they are forwarded for deposit in the spinning can.

The rotary or float mounted star 12 projects its radial fingers 14 so as to extend between the conveyor belts 11 and 11*a* and to project out over the circumference of the winding body formed by the individual yarn windings on the conveyor belts. These belts 11 and 11*a* are preferably provided with transverse teeth, grooves or ridges as schematically indicated so as to securely receive the yarn windings in spaced relationship as these windings are forwarded along the cage.

The star 12 which is secured against turning by stops 13 is arranged in a slightly inclined position with reference to the axis of rotation of the rotor 5, i.e. the axis of the orbiting outlet yarn guide 4, so that its fingers 14 execute a forwarding movement on the yarn winding with the turning of the rotor 5 and its guide 4. Since one or more fingers 14 of the star 12 rest on the last or most recently formed yarn winding, this winding is shoved forwardly continuously by the star, whereby the conveyor belts 11 and 11*a* are driven in turn so as to transport all of the windings in their helical configuration until each winding falls off the lower end of the cage into the spinning can 17. This forwarding movement is independent of the means for rotating the rotor 5 and also acts independently of the traversing movements imparted to the windings as a whole.

Preferably, for purposes of the present invention, there are at least six or more conveyor belts arranged as the cage means 9 mounted on trunnion 7 and with the same number of fingers in the star 12. And it will be further evident from FIGS. 1 and 2 that the conveyor belts 11 are arranged in such a way that they incline inwardly toward each other in the downward direction, e.g. to give a gradually decreasing radius to the windings as they progress downwardly in the axial direction. In order to ensure that the poygonal yarn windings maintain the same length, a second set of conveyor belts 11*a* are arranged with an opposite inclination, as shown particularly in FIG. 2, thereby deforming winding body as it is conveyed on the belts 11 and 11*a* into an elongated polygonal shape. Upon discharge from the cage, these windings of deformed cross section tend to fall freely into a more smoothly curved oval shape, i.e. with the sides of the polygon being slightly curved and joined by relatively smooth curves to provide an elongated oval or elliptical kind of winding. This arrangement also leads to the result that the free-falling yarn windings 31 retain a flattened, elongated form as they impinge or land upon the accumulated yarn windings 18 already present in the can 17.

The spinning can 17 rotates in a counterclockwise direction 19 as viewed from above, and the carrier member 28 mounted by means of the swivel or pivot shaft 20 on bearings 21 is turned back and forth with the traversing movement 22 by means of the motor M' and any suitable drive linkage indicated by the broken line connection to the shaft 20. The rotor 5 is independently driven by its upper shaft 30 connected to motor M.

Figure 3:
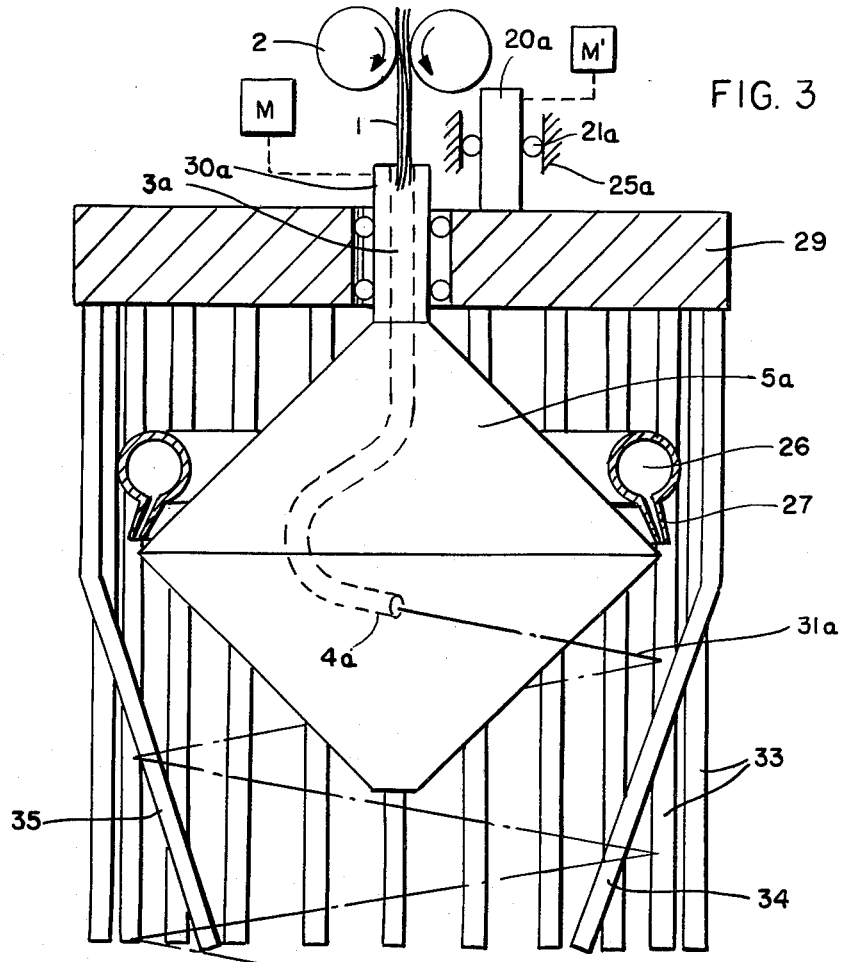
FIG. 3 is a longitudinal section through the axis of another embodiment of apparatus according to the invention giving another example of shaping and depositing means which act on the yarn windings being deposited into a spinning can.

In FIG. 3, there is shown an apparatus which corresponds substantially to that disclosed in U.S. Pat. No. 4,221,345, which is to be considered as part of the present disclosure. Here, the yarn 1 is conveyed by the feed rolls 2 or another suitable delivery means into the yarn channel or tube 3*a* of the rotor 5*a* which in turn is rotatably driven over its upper shaft 30*a* by means of a motor M. The speed of rotation is such that the yarn outlet guide 4*a* orbits in a substantially horizontal plane at about the linear velocity of the yarn. This known operation results in the formation of the freely falling yarn windings 31*a*. In order to partially compensate for air resistance to which the windings are exposed, a ring manifold 26 leads air under pressure to the annular slot nozzle 27 to form a downwardly directed air curtain which first widens radially and then contracts again so as to approximately follow the outer diameter of the rotor 5*a*, thereby providing a desired downward conveyance effect to the windings.

The carrier member 29 in this case forms the upper end of a cage with the cage bars 33, 34 and 35 joined firmly at their upper ends to this carrier. Most of the cage bars 33 encircle the yarn windings and act as retaining guides to prevent the windings from breaking outwardly in the event of local disturbances such as a sudden air turbulence or other unforeseen violent air movement. The two inwardly bent cage bars 34 and 35, which lie in the sectional plane of FIG. 3, are positioned so as to extend into the falling zone of the freely falling helical windings 31*a*. Hereby the individual windings are deformed and flattened or squeezed inwardly at two diametrically opposite points so that the yarn winding impinges on the collecting or deposit plane with the appearance of a figure eight, i.e. with a constricted midsection of a deformed circle or oval. This shape of the deformed winding can best be seen in FIG. 4.

Figure 4:
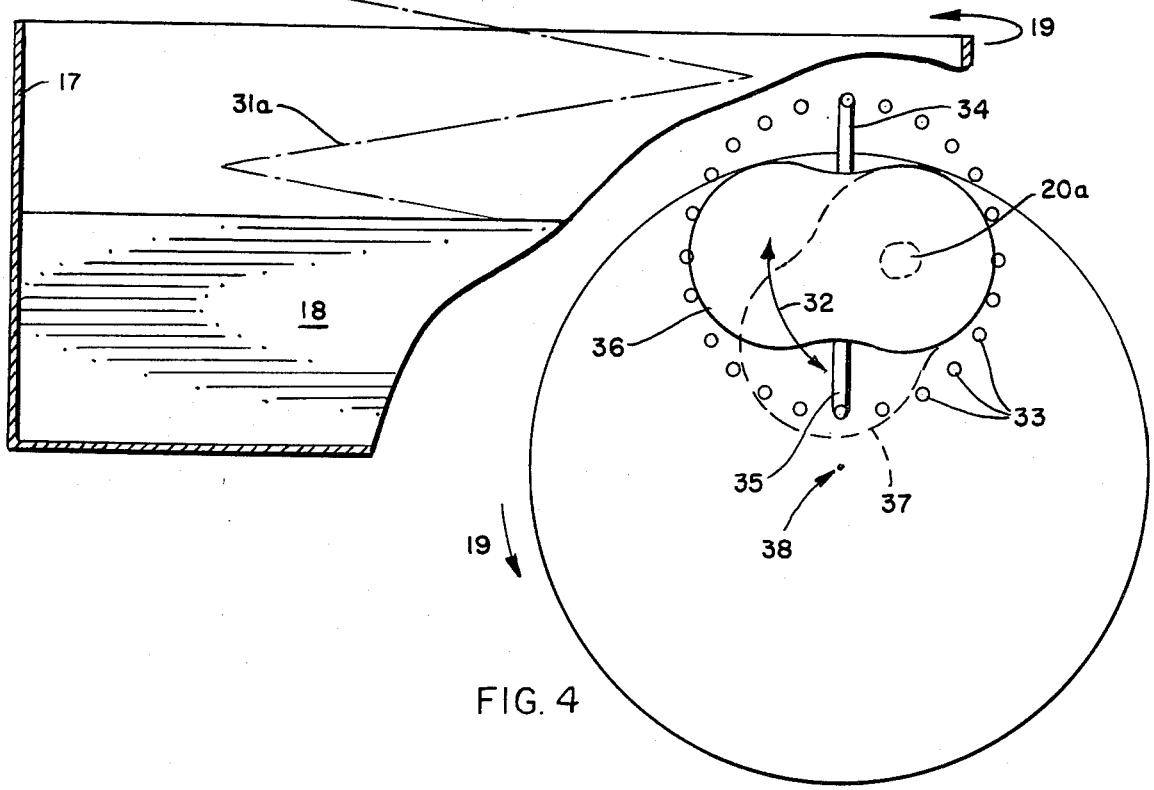
FIG. 4 is a horizontal section through the lower portion of the apparatus of FIG. 3, as viewed from above and with some portions omitted.

The unique traversing technique of the present invention is also best understood by reference to FIG. 4 as applied to both of the illustrated embodiments of the invention. It will first be noted that the spinning can 17 executes a rotary movement 19 about the center 38. Simultaneously, the yarn depositing means of both FIG. 1 and FIG. 3 execute a traversing movement 22 and 32, respectively, as the depositing means of FIG. 1 is swiveled back and forth on the shaft 20 and the depositing means of FIG. 3 is swiveled back and forth on the shaft 20*a*. The motor M′ provides the drive for these traversing movements in each case. The bearings 21 and 21*a* support the respective shafts 20 and 20*a* in the respective machine frames 25 and 25*a*.

As will now be evident from FIG. 4, the swivel or pivot axes 20 and 20*a* are arranged in such a way and the traversing movement is executed in such a way that the one end of the flattened or constricted helical yarn winding 31 and 31*a* always lies essentially against the inner wall or inner circumference of the can 17, while the other end of the winding is moved back and forth between the wall of the can and its center zone. In general, this traversing movement will always extend over an annular zone which occupies at least a portion of the area between the inner wall of the can and the centerpoint, as indicated in FIG. 4 by the two end positions 36 and 37 of the traversing movement. With this movement and the particular kind of deformation imparted to the yarn windings, it has now become possible to achieve a very uniform and even filling of the spinning can over its entire cross section.

The respective traversing movements 22 and 32 are preferably carried out substantially uniformly, but it will be obvious that these movements may also be carried out at variable speeds so as to adapt to particular requirements. The entire system or assembly when constructed and arranged in accordance with the invention offers a wide selection of elongated curved shapes as well as specific flattened or constricted configurations which will not only provide a uniform filling of the spinning can but will also be arranged therein so as to permit a rapid run-off free of serious problems such as tangling, thread breakage and the like.

The invention is especially adapted for use with spun filaments of a synthetic fiber-forming material. e.g. polyesters, polyolefins, nylons and the like. The yarn may be a monofilament yarn or one composed of continuous multifilaments. The invention is also especially useful as applied to yarns which are being fed or forwarded to the point of forming the windings at speeds in excess of 4,000 meters per minute.

The invention is hereby claimed as follows:

1. A method for depositing a continuously forwarded yarn into a round, rotating spinning can wherein the yarn is conducted in its axial direction through a guide channel having an outlet guide which orbits in a substantially horizontal circular path at about the linear velocity of the yarn and wherein the yarn is subsequently permitted to fall freely in helically shaped windings onto the circular collecting plane of said spinning can, the improvement which comprises:

shaping the yarn windings before their impingement onto said collecting plane by means of axially extending shaping surfaces placed in contact with the yarn windings so that each winding defines, in its projection onto said collecting plane of the spinning can, an elongated, closed curve with rounded ends; and moving the windings, as a whole, horizontally with reference to said collecting plane such that said closed curve defined by each winding is always disposed with one end on the outer circumference of said collecting plane of the rotating spinning can and with the other end being moved back and forth in an annular zone between the outer circumference of the collecting plane of the spinning can and its center.

2. A method as claimed in claim 1 wherein the yarn windings are shaped into an elongated, closed, smooth curve in the form of a circle which has been squeezed together from diametrically opposite points while retaining rounded ends.

3. A method as claimed in claim 2 wherein said closed curve has an oval shape.

4. A method as claimed in claim 2 wherein said closed curve has convex rounded ends and a concave midsection with reference to its center point.

5. A method as claimed in claim 2 wherein said closed curve is initially formed as an elongated polygonal shape with its sides joined into a smooth curve.

6. A method as claimed in claim 1 wherein the yarn is a continuous multifilament synthetic fiber yarn.

7. A method as claimed in claim 1 wherein the yarn is forwarded into the guide channel at a linear feed velocity of more than about 4,000 meters per minute.

8. A method as claimed in claim 1 which further comprises forming the yarn windings about a substantially vertical axis corresponding to the axis of rotation of said outlet guide, and swiveling the windings, as a whole, back and forth about a vertical pivot axis offset from said guide axis of rotation in a traversing pattern sufficient to uniformly lay the shaped windings onto the collecting plane of the rotating, round spinning can.

9. In apparatus for depositing a continuously forwarded yarn into a round, rotating spinning can including a rotor which contains a yarn guide channel with an outlet guide means orbiting in a substantially horizontal circular path about a substantially vertical axis of rotation, said spinning can being positioned below the outlet guide means to receive the yarn windings freely falling from said outlet guide means, the improvement comprising:

a carrier member for rotatably mounting said rotor about said vertical axis of rotation with means to swivel said carrier member back and forth in a substantially horizontal plane about a vertical pivot axis offset from said axis of rotation;

cage means float mounted on a shaft of said rotor and having axially projecting shaping elements extending below said carrier member in positions to receive the yarn windings and form them into an elongated, closed curve as projected onto the collecting plane of said spinning can; and means to restrain said cage means from rotating about said vertical axis of rotation.

10. Apparatus as claimed in claim 9 wherein said axially projecting shaping elements are attached to and depend from said carrier member, said shaping elements extending around and below said rotor in order to intercept the yarn windings during their free fall and to form them into said elongated, closed curve.

* * * * *